US005269386A

United States Patent [19]

Schivley, Jr. et al.

[11] Patent Number: 5,269,386

[45] Date of Patent: Dec. 14, 1993

[54] SELF POSITIONING DUST SEAL HOLDER

[75] Inventors: George P. Schivley, Jr., Richardson, Tex.; Stuart A. Connell, Roanoke, Va.

[73] Assignee: Ingersoll-Rand Company, Woodcliff Lake, N.J.

[21] Appl. No.: 935,803

[22] Filed: Aug. 27, 1992

[51] Int. Cl.[5] ..... E21B 21/00; E21B 15/04; E21C 7/02

[52] U.S. Cl. ..... 175/211; 175/209

[58] Field of Search ..... 175/209, 211, 210; 173/185; 52/116, 117

[56] References Cited

U.S. PATENT DOCUMENTS

| | | | |
|---|---|---|---|
| 1,930,099 | 10/1933 | Kelley . | |
| 2,590,958 | 4/1952 | Goodrich | 175/209 |
| 2,721,725 | 10/1955 | Biggs et al. . | |
| 2,781,185 | 2/1957 | Robbins | 175/209 X |
| 2,838,282 | 6/1958 | Colquitt | 175/211 X |
| 2,913,226 | 11/1959 | Pritchard et al. | 175/209 X |
| 3,190,375 | 6/1965 | Pearson | 175/209 X |
| 3,811,518 | 5/1974 | Kalaf et al. | 175/209 X |
| 3,834,470 | 9/1974 | Gyongyosi et al. | 175/211 |
| 3,992,831 | 11/1976 | Bukovitz et al. | 52/116 |
| 4,429,754 | 2/1984 | Cormier | 175/209 X |
| 4,434,861 | 3/1984 | Howeth | 175/66 |
| 4,440,243 | 4/1984 | Howeth | 175/209 |
| 4,444,280 | 4/1984 | Howeth | 175/206 |

*Primary Examiner*—Hoang C. Dang
*Attorney, Agent, or Firm*—John J. Selko

[57] ABSTRACT

A drilling apparatus, having a drilling tower, tiltable for angle drilling, on a drilling platform with an aperture for a drill string, includes a dust seal holder that extends into the aperture in the platform, the dust seal holder being connected to the tower, so as to move up and down in the aperture in an arcuate path along with the drilling tower, as the tower is tilted for angle drilling, the dust seal holder being disconnected from the tower, so as to be not movable, as the tower is moved between a horizontal and vertical position.

9 Claims, 4 Drawing Sheets

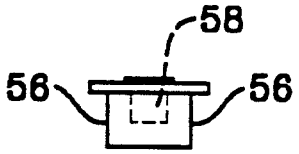
FIG. 5
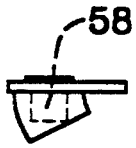
FIG. 6
FIG. 7
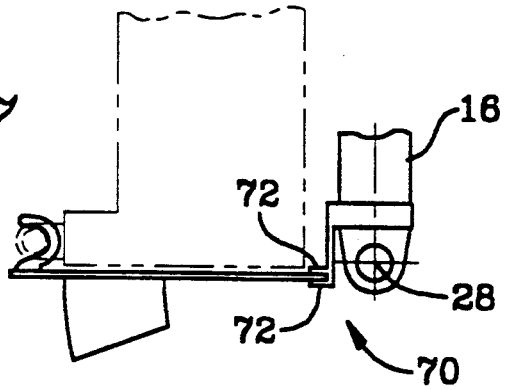
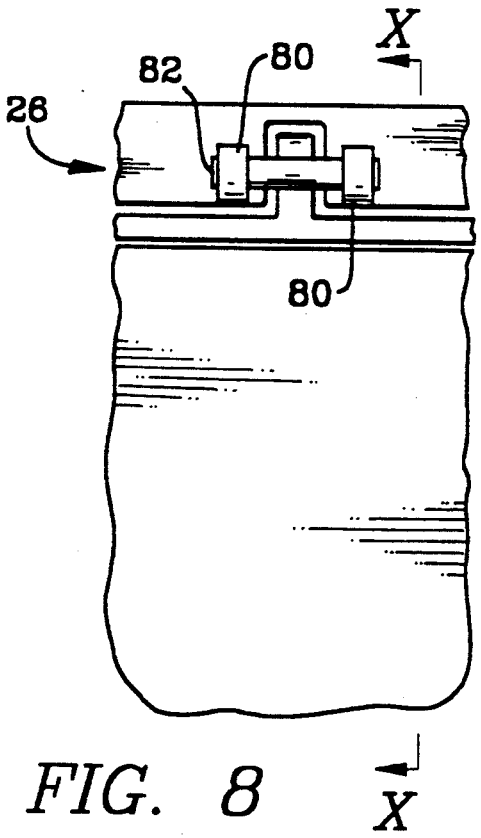
FIG. 8
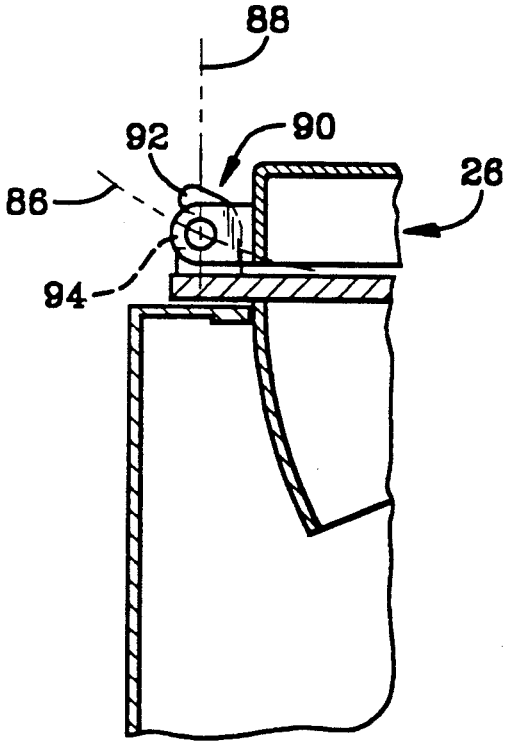
FIG. 9

SELF POSITIONING DUST SEAL HOLDER

BACKGROUND OF THE INVENTION

This invention relates generally to dust seals on drilling machines, and more particularly to dust seals on drilling machines that are tiltable for angle drilling.

The practice of drilling angled blast holes for surface mining has become quite popular. Blast holes are drilled at angles of up to 30 degrees (from the vertical). One of the primary advantages of this technique is that the blast itself will move some material which overlays the ore being mined, thereby leaving less material to be moved by shovels.

Drilling angled blast holes has created new problems when it comes to containing the dust which is produced by the process. On those drills which have a platform through which the drill pipe and bit must pass, it is necessary to maintain a fixed orientation of the dust seal assembly relative to the centerline of the drill pipe to maintain effective sealing This requirement is further complicated by the fact that a given drill rig may drill at several different angles in the course of drilling a particular area to be mined. Therefore, the means of orienting the seal assembly must be easily adjustable.

Finally, on some occasions, water will be encountered when drilling a blast hole. The air which flushes the cuttings out of the hole will also flush the water. This airborne water and dust can become packed in any type of mechanical linkage and render it inoperative.

The foregoing illustrates limitations known to exist in present dust seals. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a dust seal holder comprising a hollow duct adapted to extend into an aperture in a drill platform, to surround a drill string; means for pivotal connecting the dust seal holder to the drill tower for pivoting the dust seal holder up and down in the aperture along an arcuate path; and means for automatically disconnecting the dust seal holder from the drill tower when the tower is pivoted between a horizontal and vertical position, and for automatically connecting the dust seal holder to the tower when the tower is tilted for angle drilling.

The foregoing and other aspects will become apparent from the following detailed description of the invention when considered in conjunction with the accompanying drawing figures.

BRIEF DESCRIPTION OF THE DRAWING FIGURES

FIG. 5 is a front elevational view of the duct of this invention;

FIG. 6 is a side elevational view of the duct of this invention;

FIG. 7 is an expanded side elevational view showing the invention latched in position on a drilling tower bottom;

FIG. 8 is an expanded front elevational view, with parts removed, of the latch of this invention.

FIG. 9 is a cross sectional view along X—X of FIG. 8;

DETAILED DESCRIPTION

Figure 1:
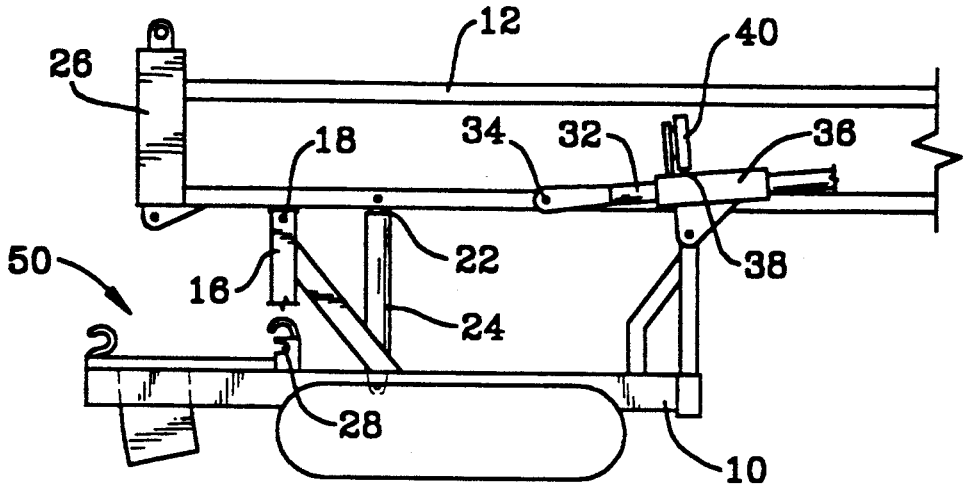
FIG. 1 is a schematic side view showing a drill tower and the invention mounted on a mobile platform in a horizontal position.

Referring to the drawings, and more particularly to FIG. 1, a mobile platform 10 supports a drill tower 12. A pair of laterally spaced and connected supports 16 (only one shown) extend upwardly from the platform 10. Each support 16 is the same and a description of one will suffice for both. When the drill tower !2 is in the horizontal position, the drill tower is pivotally connected to the upper portion of supports 16 at an upper pivot axis 18 on each support 16.

Figure 2:
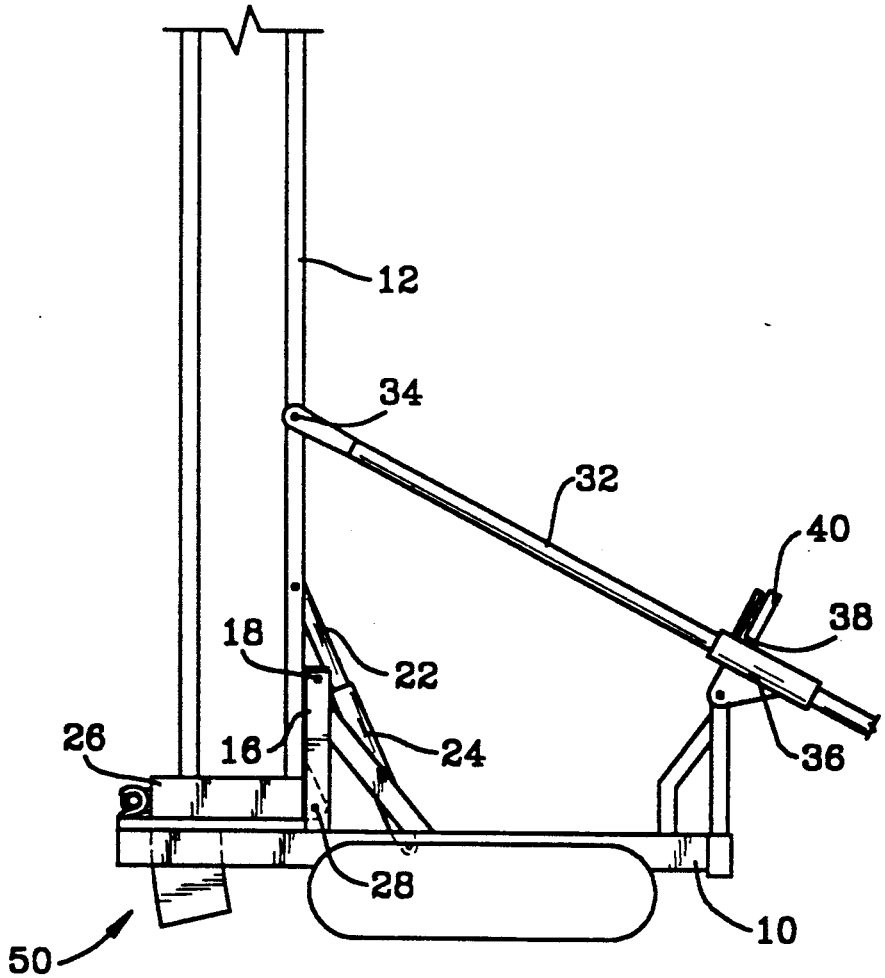
FIG. 2 is a schematic side view showing the drill tower in its vertical position.

To pivot the drill tower 12 from the horizontal position to the vertical position shown in FIG. 2, a hydraulically actuated rod 22 actuated by hydraulic fluid in hydraulic cylinder 24 pivots drill tower 12 about the upper pivot axis 18 in each tower support 16. When the drill tower 12 is pivoted to the vertical position, a part of the drill tower 12 adjacent the drill tower bottom 26 engages the lower pivot axis 28.

Figure 3:
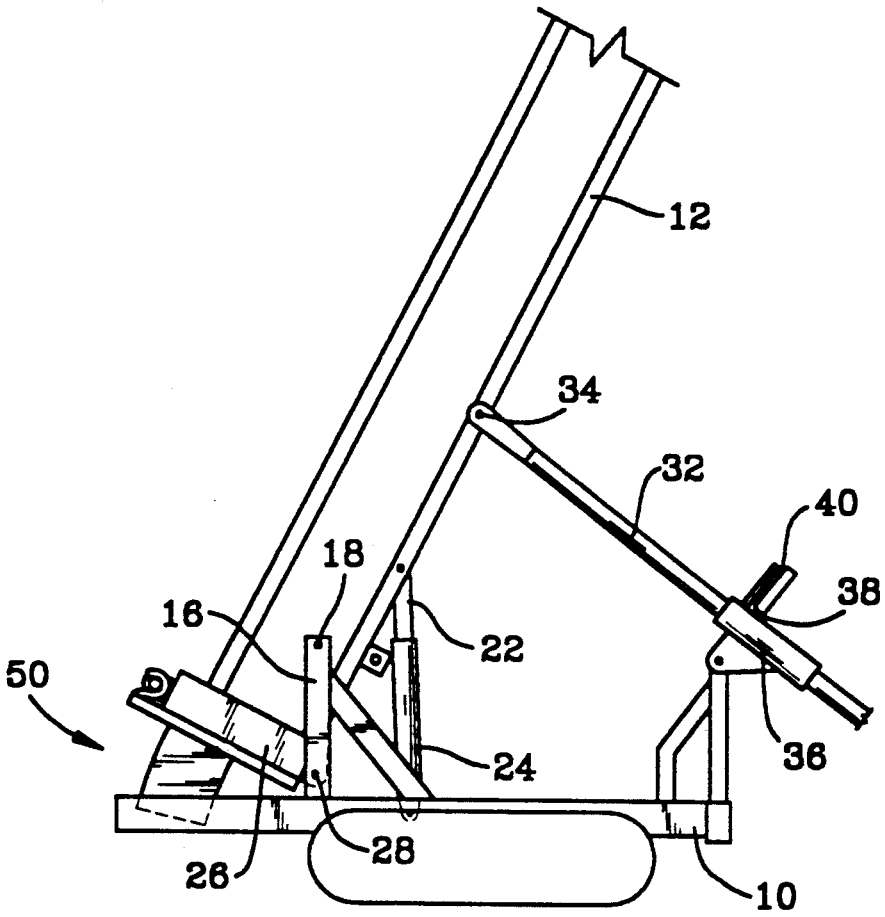
FIG. 3 is a schematic side view showing the drill tower at an angle for angle drilling.

As shown in FIG. 3, the drill tower 12 after it has been securely and positively locked in the lower pivots 28, may be pivoted about said pivots for angle drilling. The actual angle the drill is from the vertical, is determined by a pair of arms 32 (only one shown). Each arm 32 has its outer end connected to the drill tower 12 at 34, and the arm 32 extends through an arm support 36. A pneumatic rod 38 operated by air in a pneumatic cylinder 40 extends through the arm support 36 and into one of a plurality of longitudinally spaced holes (not shown) in the arm 32.

The particular angle of the drill tower 12 with respect to the vertical is set by actuating rod 22 by means of hydraulic cylinder 24 to pivot the drill tower 12 about pivot axis 28. While this is done, the pneumatic rod 38 is in the retracted position so that the shaft 32 will move longitudinally within the shaft support 36. When a predetermined hole in shaft 32 is in position, the pneumatic rod 38 is actuated to enter into the hole and lock the drill tower at the desired angle. This arrangement is conventional, and is more fully described in Bukovitz et al. U.S. Pat. No. 3,992,831. The dust seal holder of this invention is shown generally as 50.

Figure 4:
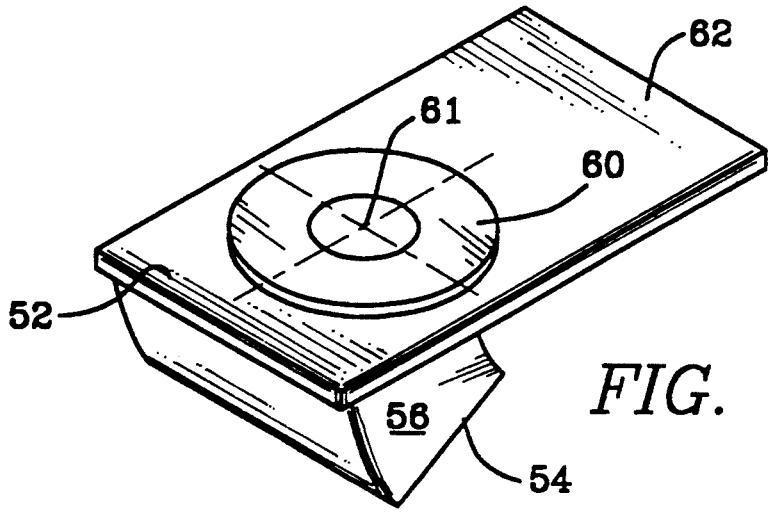
FIG. 4 is an isometric view of the dust seal holder of this invention.

Referring to FIG. 4, the dust seal holder itself is shown. It comprises a flat plate 52 from which a curved duct 54 projects downward. The sides 56 of the curved duct 54 are flat and vertical, as shown in FIG. 5, although they can be curved also. This curved duct 54 fits into a rectangular aperture in the drill rig bottom, as shown in FIGS. 1–3. Inside the curved duct is the dust seal 58 (FIGS. 4–5). The detailed design of the dust seal 58 is not relevant to this disclosure and can be a variety of schemes. The design includes rubber seals around the perimeter of the curved duct, similar to those used commonly to seal between moving and stationary elements.

Plate 52 extends in a plane outwardly around duct 54 a sufficient distance to cover the aperture in the drilling bottom 26, so that any space between the sides 56 of duct 54 and the aperture are substantially sealed against the upward flow of dust from the drill hole therebelow. Plate 52 has an aperture 60 positioned over the axial centerline 61 of dust 54, which aperture permits passage therethrough of the drill string (not shown). One end 62 of plate 52 is used for pivotably connecting the duct to the tower supports 16 at pivot axis 28, is more clearly shown in FIG. 7.

Keeper 70 comprising a pair of spaced apart flanges 72 extending lengthwise along plate end 62. Plate end 6 is connected to keeper 70 by friction force fit, or by welding, if desired. Keeper 70 is, in turn pivotably connected to tower support 16, as by welding, so as to have a pivot axis that coincides with the pivot axis 28 used by tower bottom 26 during tilting movement, as described hereinafter.

Figure 10:
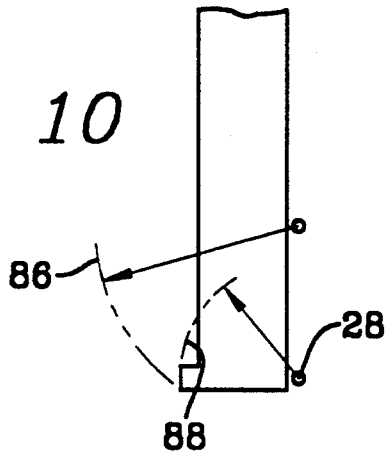
FIG. 10 is a schematic view showing two arcuate paths followed by a part of the latch mechanism of this invention, during movement, of the tower.

Referring to FIGS. 7, 10, means for automatically connecting and disconnecting duct 54 from tower 12 are shown to include a pair of spaced apart clevises 80, with a pivot pin 82 extending therebetween, mounted on bottom 26 of tower 12. Pivot pin 82 moves in a first arcuate path 86 when tower 12 is pivoted about upper pivot axis 18, and in a second arcuate path 88 when tower 12 is pivoted about lower pivot axis 28 (FIG. 10). A latch member 90 is fastened to plate 52. Latch member 90 includes an upwardly extending, curved, hooked arm 92 forming a latch opening 94. Latch member 90 is positioned on plate 52 so that duct 54 is located between latch member 90 and keeper 70. Clevises 80 and pin 82 are likewise positioned. One or more latch members can be used.

Figure 11A:
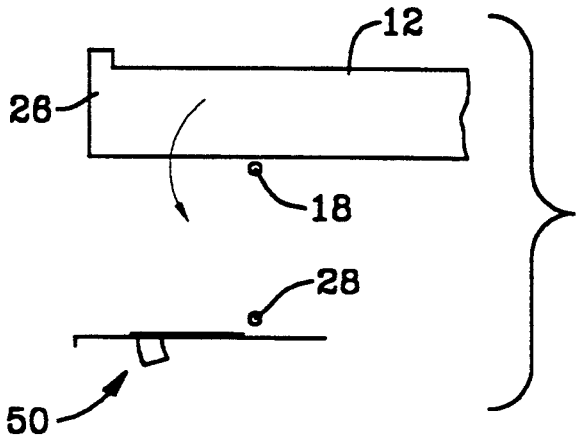
FIG. 11 is a schematic view showing the tower, in phantom, rotating about two different pivot axes and the invention rotating about one pivot axis with the tower.
Figure 11B:
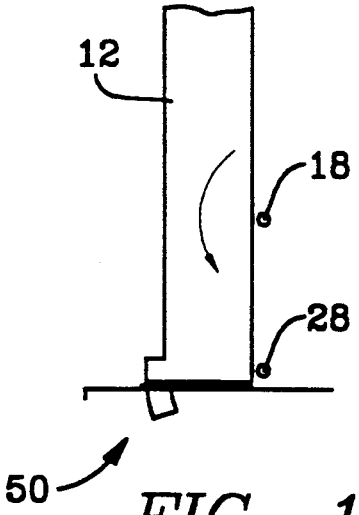
Figure 11C:
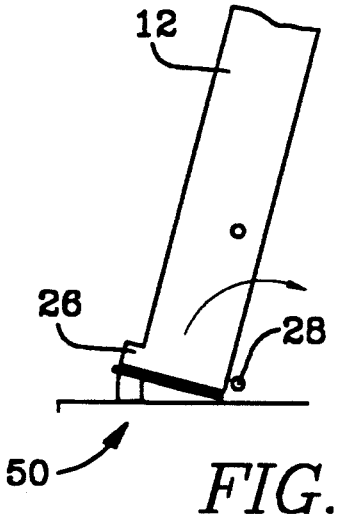

Referring to FIG. 11, the tower 12 is shown pivoting about upper pivot axis 18, in view A. In view B, the tower 12 is shown in the vertical position engaging the dust holder of this invention. In view C, the tower 12 and dust seal holder, 50 are shown pivoting about lower pivot axis 28, for side angle drilling.

In operation, with the pin 82 in the position shown in FIG. 9 and the top plate 52 engaged in the keeper 70, as in FIG. 8, when the tower 12, support member 16, and tower bottom 26 pivot about pivot point 28, the dust seal holder 50 will pivot with them.

The action which keeps the pin 82 and the latch 90 engaged is the different arc which the pin 82 moves through when the tower 12 is being rotated from a horizontal position (about pivot axis 18) versus the arc it moves through when the tower is being rotated to drill at an angle (about pivot axis 28). The pin 82 cannot get out of the latch 90 when moving in the arc described from pivot axis 28. When the tower 12 is in the horizontal position, the dust seal holder assembly will remain in the drill rig bottom 10.

While I have disclosed the dust seal holder 50 connected to tower support 16, so as to pivot about lower pivot axis 28, it would be equivalent to provide a separate pivot axis for the duct, which pivot axis could be connected to the nonpivotable drilling platform 10, so long as the operation of the up and down movement and engagement and disengagement actions of the dust seal holder were provided.

It should be understood that a major benefit of the invention is for the dust seal holder and the dust seal to move in such a way as to maintain a fixed orientation of the dust seal relative to the centerline of the drill pipe.

While this invention has been illustrated and described in accordance with a preferred embodiment, it is recognized that other variations and changes may be made therein without departing from the invention as set forth in the claims.

Having described the invention, what is claimed is:

1. In a drilling apparatus having a drilling platform; an aperture in said platform for a drill string; a drill tower support on said platform; a drill tower connected to said tower support, said drill tower selectively pivotable about an upper pivot axis on said tower support, when said tower is moved between a horizontal and vertical position, and about a lower pivot axis on said tower support, when said tower is tilted for angle drilling, the improvement comprising:

a dust seal holder comprising:

(a) a hollow duct adapted to extend in said aperture, for surrounding said drill string with a dust seal, said duct movable up and down in said aperture;

(b) means for pivotably connecting said duct to said tower support for pivoting about said lower pivot axis, to permit said duct to move up and down in said aperture along an arcuate path; and (c) means for automatically connecting said duct to said tower, when said tower is pivoted about said lower pivot axis, and for automatically disconnecting said duct from said tower, when said tower is pivoted about said upper pivot axis.

2. The dust seal holder of claim 1 wherein said means for pivotably connecting said duct to said tower comprises:

(a) a top plate connected to said duct, said plate having an aperture therein positioned over said duct, for surrounding a drill string, said plate extending in a plane outwardly around said duct to close said aperture in said platform;

(b) a keeper fastened to an end of said top plate; and (c) means for pivoting said keeper about said lower pivot axis.

3. The dust seal holder of claim 2 wherein said means for automatically connecting and disconnecting said duct and said tower comprises:

(a) pair of spaced apart clevises on said tower;

(b) a pin extending between said clevises, said pin moving in a first arcuate path when said tower is pivoted about said upper pivot axis and in a second arcuate path when said tower is pivoted about said lower pivot axis; and (c) a latch member on said plate, said latch member adapted to hold said pin, when said tower is pivoted about said lower axis and to release said pin, when said tower is pivoted about said upper pivot axis.

4. The dust seal holder of claim 3 wherein said duct has a body that curves parallel to said second arcuate path of movement.

5. The dust seal holder of claim 4 wherein said latch member includes a curved hook arm forming a latch opening, said curved hook arm positioned on said duct to engage said pin when it moves along said second arcuate path, and to disengage from said pin when it moves along said first arcuate path.

6. The dust seal holder of claim 5 further including sealing means in said duct for contacting said drill string to seal against flow of dust from a drill hole.

7. In a drilling apparatus having a drilling platform; an aperture in said platform for a drill string; a drill tower support on said platform; a drill tower connected to said tower support, said drill tower selectively pivotable about an upper pivot axis, when said tower is moved between a horizontal and vertical position, and about a lower pivot axis, when said tower is tilted for angle drilling, the improvement comprising:

a dust seal holder comprising:

(a) a hollow duct adapted to extend in said aperture, for surrounding said drill string with a dust seal, said duct movable up and down in said aperture;

(b) means for pivotably connecting said duct to said platform for pivoting about a duct pivot axis, to permit said duct to move up and down in said aperture along an arcuate path; and (c) means for pivoting said duct along with said tower, when said tower is pivoted about said lower pivot axis, and for not pivoting said duct, when said tower is pivoted about said upper pivot axis.

8. The dust seal holder of claim 7 wherein said lower pivot axis and said duct pivot axis coincide.

9. In a drilling apparatus having a drilling platform; an aperture in said platform for a drill string; a drill tower support on said platform; a drill tower connected to said tower support, said drill tower selectively pivotable about an upper pivot axis, when said tower is moved between a horizontal and vertical position, and about a lower pivot axis, when said tower is tilted for angle drilling, the improvement comprising:

(a) a dust seal holder adapted to extend in said aperture, for surrounding said drill string with a dust seal, said dust seal holder movable up and down in said aperture;

(b) means for pivotably connecting said dust seal holder to said tower for pivoting about said lower pivot axis, to permit said dust seal holder to move up and down in said aperture along an arcuate path; and (c) means for automatically connecting said dust seal holder to said tower, when said tower is pivoted about said lower pivot axis, and for automatically disconnecting said dust seal holder from said tower, when said tower is pivoted about said upper pivot axis.

* * * * *